United States Patent [19]

Hanopole

[11] 4,015,719

[45] Apr. 5, 1977

[54] FLOATING NET DISPLAY APPARATUS

[75] Inventor: Irwin Hanopole, West Orange, N.J.

[73] Assignee: Magla Products, Irvington, N.J.

[22] Filed: Jan. 6, 1975

[21] Appl. No.: 538,474

[52] U.S. Cl. ..... 211/133; 248/97; 248/100; 248/159

[51] Int. Cl.[2] ..... A47F 1/06

[58] Field of Search ..... 40/124.4, 125 R, 145 R; D6/20, 23, 28; 248/97, 100, 159; 211/133, 33, 88, 14, 196, 107, 112; 206/44.11, 44.12, 315, 44 R; D80/8; D9/242, 243, 247, 249; 40/145 R

[56] References Cited

UNITED STATES PATENTS

| | | | |
|---|---|---|---|
| 355,361 | 1/1887 | Walsh | 150/1 X |
| 835,445 | 11/1906 | Leonard | 211/196 X |
| 1,035,895 | 8/1912 | Norwood | 211/107 |
| 2,285,411 | 6/1942 | Brewster | 211/107 |
| 2,503,359 | 4/1950 | Smith | 40/124.4 |
| 2,552,443 | 5/1951 | Molinari | 150/1.7 UX |
| 2,689,050 | 9/1954 | Albin | 40/125 R X |
| 2,865,122 | 12/1958 | Clawson | 40/124.4 |
| 3,294,295 | 12/1966 | Wolf | D80/8 UX |
| 3,322,176 | 5/1967 | Geller | 150/1.7 |
| 3,414,133 | 12/1968 | Guerri et al. | 211/133 |
| 3,839,525 | 10/1974 | Doll | 150/1 X |
| 3,853,226 | 12/1974 | Hine et al. | 40/124.4 X |
| 3,866,872 | 2/1975 | Burgess | 248/97 |
| D35,012 | 8/1901 | Childers | D6/23 |
| D157,152 | 2/1950 | Harvey | D6/28 |

FOREIGN PATENTS OR APPLICATIONS

| | | | |
|---|---|---|---|
| 1,441,380 | 4/1966 | France | 211/133 |
| 1,165,043 | 9/1969 | United Kingdom | 211/14 |

*Primary Examiner*—Roy D. Frazier
*Assistant Examiner*—Rodney H. Bonck
*Attorney, Agent, or Firm*—Behr & Woodbridge

[57] ABSTRACT

A display apparatus includes a base, a mast supported thereon and a net attached to the top of the mast. The net is approximately square in shape and formed from a plastic material having large gaps therein. The mast passes through the center of the net and the corners of the square net are folded up and attached to the top of the mast. The mast includes a pull-apart collapsible feature and means near the top of said mast to receive a display sign. After the apparatus has been erected, the net may be filled with display merchandise. The merchandise causes the net to expand and imparts to the apparatus a "blossoming" appearance.

10 Claims, 6 Drawing Figures

FLOATING NET DISPLAY APPARATUS

BACKGROUND OF THE INVENTION

1. Field of the Invention

This invention relates to display apparatuses in general and in particular to a free-standing display apparatus including a net for receiving display merchandise therein.

2. Description of the Prior Art

Free-standing display racks are known to those of ordinary skill in the art. See, for example, U.S. Pat. No. D-39,209 and D-190,107. Another apparatus of similar structure is disclosed in Austrian Patent No. 209,526.

Additionally, devices are known which will support a bag or the like in a free standing position. Such devices are frequently used to hold garbage bags, leaf bags and the like. A similar apparatus used to facilitate the counting and disposal of surgical sponges is disclosed in U.S. Pat. No. 3,613,899.

Net supporting stands are also known to the prior art, see for example French Patent No. 1,084,618 and U.S. Pat. No. D-157,152 issued to J. W. Harvey, Feb. 7, 1950. The Harvey patent discloses a supported net apparatus in the context of a display stand.

Conventional display stands, such as those known in the prior art, often tend to be expensive and difficult to erect. Additionally, many prior art stands are aesthetically unpleasing. It was in the context of the foregoing prior art and problems that the present invention arose.

SUMMARY OF THE INVENTION

Briefly described, the invention comprises a display stand apparatus which includes a base, a mast connected thereto and a net attached to the top of said mast. The net is preferably square in shape and includes a plurality of corners where the edges coincide. The mast passes approximately through the center of the net and the corners of the net are brought up and attached to the top of the mast. The net is thus draped from the top of the mast like a sack and is adapted to receive display merchandise which may be placed into the netting through the openings formed in the top thereof between the corners of the net.

The base of the stand includes at least three triangular shaped legs which provide free standing support to the mast. The mast is collapsible and includes at least one pull apart section intermediate the top and bottom ends thereof. Near the top of the mast are a plurality of attaching means adapted for connection to the corners of the display net. The attaching means may be hooks or nails or other suitable connecting devices which will also suitably fasten the net to the top of the mast. Also associated with the top of the mast is a means for receiving a suitable display sign.

The plastic netting is preferably square in shape and includes gaps therein with dimensions of approximately 1 inch × 1½ inch. A suitable plastic netting is known as "VEXAR" and is manufactured by E.I. DuPont de nemours & Co., Inc. of Wilmington, Delaware.

There are several advantages obtained by this structure. First of all, it is relatively inexpensive and easy to erect. Secondly, it is well balanced since the mast passes directly through the center of gravity of the netting and therefore the center of gravity of the display merchandise. And third, the merchandise is displayed at approximately eye level and provides easy access to those customers who would wish to remove an article from the netting. These and other advantages of the present invention will be more fully understood with reference to the following drawings.

DETAILED DESCRIPTION OF THE INVENTION

During the course of the disclosure, like numbers will be used to identify like elements according to the different figures.

Figure 1:
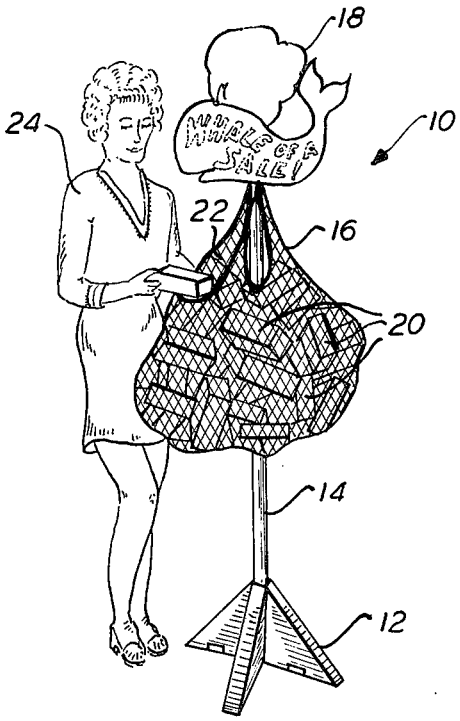
FIG. 1 is an elevated view of the floating net display apparatus according to the present invention.

The floating net display stand apparatus of the present invention is illustrated in its assembled state in FIG. 1. The floating net display apparatus 10 comprises a base 12, a mast or pole 14 attached at the bottom thereof to base 12 and a display net 16 attached to the top of mast 14. Also attached to the top of mast 14 is a display sign 18 which may include any kind of message thereon intended to attract the attention of a potential customer. The display net 16 is shown to contain a plurality of display merchandise on articles 20. Preferably, the display merchandise is small enough to pass through openings 22 in the net 16, but large enough so that they do not pass through the gaps in the net. The openings 22 are of sufficient size to allow a customer 24 to reach into the display net 16 and draw out an article 20 with a minimum of inconvenience. The mast 14 passes through the center of the display net 16 so that the center of gravity of the display articles 20 coincides with the axis of the mast 14. This contributes to a balanced and symmetrical display.

Articles 20 displayed in this fashion receive considerable attention because they are located at or near eye level and because the bunching of the display articles 20 gives the display apparatus 10 the appearance of "blossoming". This is a very pleasing appearance and contributes to an aesthetically attractive display.

Figure 2:
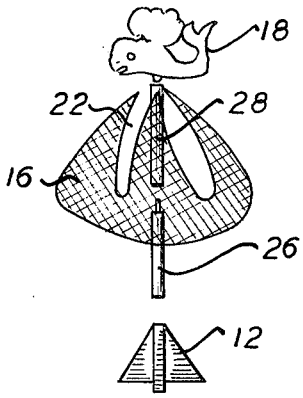
FIG. 2 is an exploded view of the floating net display apparatus of FIG. 1.

An exploded view of the display stand 10 of the present invention is seen in FIG. 2. The display stand 10 is shown to include the following discreet and separable components: a base 12, the bottom half 26 of the mast 14, the top half 28 of the mast 14, a display sign 18 and the display net 16. The whole apparatus can be knocked down into these five elements and the base 12 could further be knocked down into two separate halves which dovetail into one another to form the base. The whole display stand 10 can be stored in a small, flat carton and erected at almost any desired location in a matter of minutes.

The individual elements comprising the display stand 10 are shown in detail in FIGS. 3 through 6.

Figure 3:
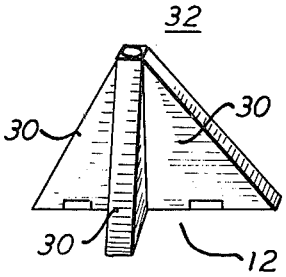
FIG. 3 is a view of the base of the invention.

The base 12 of the display apparatus 10 is shown in detail in FIG. 3. The base 12 includes at least three triangular shaped legs 30. One corner of the triangular leg 30 comprises a right triangle of 90° at the conjunction of the verticle and base section of the leg 30. At the top of the base 12 is a hole 32 adapted to receive the bottom end of the bottom half 26 of the mast 14.

According to a preferred embodiment, the base 12 is collapsible and can be separated into two or more separate sections in a manner well known to those of ordinary skill in the art. This may be accomplished by dovetailing one section into the other. It is preferred that the stand be collapsible so that it occupy a minimum amount of space in a storage container.

Figure 4:
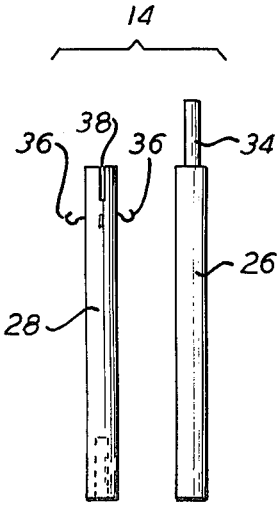
FIG. 4 is a view of the two section comprising the collapsible mast of the invention.

According to FIG. 4, the mast 14 includes a bottom half 26 and a top half 28. The bottom half 26 has a diameter such that it fits snugly within the hole 32 of the base 12. The top portion of the bottom half 26 includes a plug 34 which is adapted to fit into the bottom portion of the top half 28. The mast 14 is therefore collapsible and can be erected merely by placing the plug 34 into the hollow portion of the top half 28. The top portion or section of the top half 28 of the mast 14 includes a plurality of attaching means 36 and a slot 38. The attaching means 36 are for connecting the corners 40 of the net 16 to the top of the mast 14. The attaching means may comprise hooks, or nails, or any other suitable device that may readily and securely attach the netting 16 to the mast 14. Suitable devices for achieving this result are known to those of ordinary skill in the art.

Figure 5:
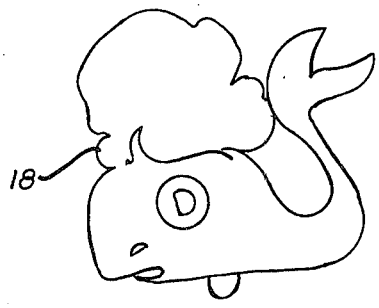
FIG. 5 is an illustration of a typical display sign that might be attached to the top of the display stand.

A display sign 18 typical of the sort that might be used with the floating net display apparatus 10 is illustrated in FIG. 5. The particular shape and message of the display is not meant to be limitative of the type that might be used with this apparatus. The display sign 18 is receivable within the slot 38 in the top half 28 of the mast 14. A slot receiving means is preferable to other techniques because it is one of the least expensive and efficient means of attachment for such display signs. The purpose of the display sign is to identify the display and draw attention thereto.

Figure 6:
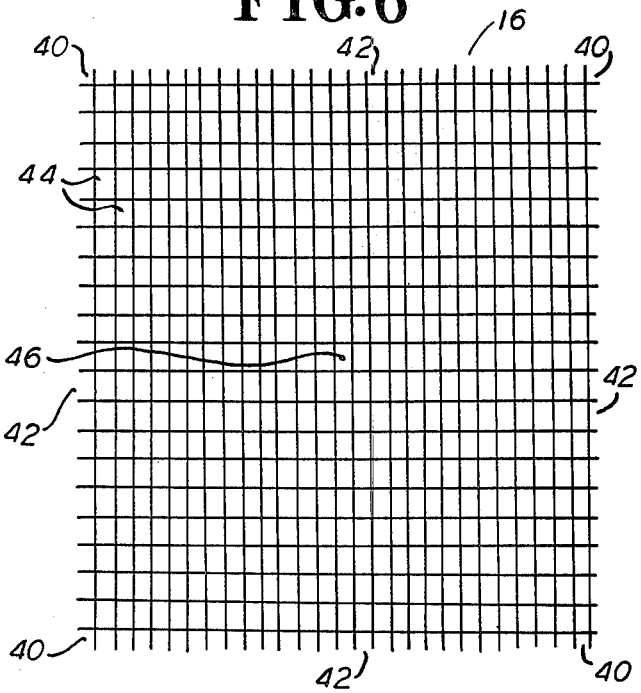
FIG. 6 is a top plan view of the display net as shown in its flat state.

The net 16 associated with the display 10 is illustrated in FIG. 6. The net 16 preferably has a polygonal shape and may be, for example, a triangle, square, pentagon, hexagon or similar polygon. In a preferred embodiment, the net 16 is a square or rectangle having a plurality of corners 40 at the intersection of the sides 42. Also, according to a preferred embodiment, the net is made of a plastic material such as VEXAR which is produced by E.I. duPont de Nemours & Company, Inc. of Wilmington, Delaware. The gaps or spaces between the netting strands measure approximately 1 inch × 1½ inch in size. The netting should be sufficiently strong to withstand the forces exerted upon it by the accumulated display items contained therein. The gaps or spaces 44 should be large enough so that the contents of the net 16 are readily visible to the consumer but should be small enough so that the display articles do not fall through. The approximate center of the net 16 is identified as 46.

In order to erect the display stand 10, the base 12 is first assembled and then placed on a level floor. The bottom half 26 of the mast 14 is then inserted into the hole 32 of the base 12. The top half 28 of the mast 14 is then plugged into the plug 34 in the top of the bottom half 26 of the mast 14. The net 16 is then placed over the mast 14 so that the mast 14 passes approximately through the center 46. The corners 40 of the net are then gathered together and attached to the attaching means 26. The attaching means, as previously described, may be hooks, nails or any other suitable device known to those of ordinary skill in the art. The net, thus gathered, provides a plurality of openings or ports 22 between the corners 40 through which the display articles may be passed. The erection of the display is completed by placing the display sign 18 into the slot 38.

The display may be loaded or unloaded through the ports 28 with little or no inconvenience. The gathered net which drapes like a bag or sack from the top of the mast 14 appears to "blossom" when filled with display artic 20. The thus formed display is physically balanced, aesthetically pleasing and attractive to the consumers. The items therein are readily visible to the potential customer because they can be placed at or near eye level.

According to an alternative method for erecting the display apparatus, the device is preloaded and partially erected and then packaged in a container having dimensions of approximately 24 inches wide × 24 inches deep × 12 inches high. In this mode, the top half of the mast 28 is placed through the center 46 of the net 16 and taped to the mast about 4 inches above the pull-apart break point. The mast 14 and net 16 assembly is then placed in the container and the corners of the net 16 are attached to the midsection of the edges of the container flap by a set of slits therein. The net 16 is thus held open by the configuration of the container. The net 16 is thereafter loaded with display articles and the corners 40 of the net 16 are drawn together and looped over the top of the mast 28 and received in slot 38. In this manner, the net may be secured to the mast without the necessity of using hooks or other similar attaching means. The loops are thereafter secured to the mast by adhesive tape. Since the mast 28 is sometimes larger than the height, width or length of the container, it may be forced into a diagonal attitude for a better packaging fit. Thereafter, the collapsible base 12, the bottom mast section 26 and the sign 18 may be placed into the container, whereafter the container is sealed and prepared for shipment. The advantage of this method is that the receipient of the container merely has to perform the following sequential steps:

1. Open the container;
2. Remove the contents;
3. Erect the collapsible base 12;
4. Insert bottom half 26 into base hole 32;
5. Plug the mast 28 and net 16 assembly into bottom mast half 26; and
6. Place the sign 18 into slot 38.

The whole operation may typically take about five minutes or less.

While the foregoing invention has been described with reference to a preferred embodiment, it will be clear to those of ordinary skill in the art that certain changes or modifications may be made which remain within the scope of the invention. For example, while netting material 16 has been discussed in the context of this invention, it will be appreciated that other types of sheet material may be useful too. For example, a flat, non-porous sheet of plastic may do, under conditions where it is desirable to protect the display items from the outside environment. Additionally, non-plastic materials, such as string netting, may be used also. When the sheet is in position, it effectively surrounds the mast. Alternatively, the invention also comprehends a display stand in which a plurality of bags are draped from the top of the mast or in which the bottom of the net is taken up to form a torus or modified torus. In fact, it is often desirable to bring the bottom of the net up a little bit in order to enhance the "blossoming" appearance. However, the use of a plurality of bags has a disadvantage of making the openings 22 smaller and may contribute to unbalancing the apparatus in general. For that reason, the preferred embodiments of the invention comprehend the passage of the mast through the net and the possible taking up of the bottom of the net to form a torus or modified torus apparatus.

The attaching means 36 are shown as being hooks, but as has been discussed throughout the context of this disclosure, it will be appreciated that other types of attaching means could be used in place thereof. For example, it has been disclosed that the corners 40 of the net 16 may be attached to the top of the mast 14 by merely looping the loops or openings 44 into the slot 38. This method of attachment has proved to be very dependable and may even be preferable to the use of hooks or the like. The slot 38 therefore serves the double function of providing an attaching means for the corners 40 of the net 16 and providing a means for receiving the sign 18. The sign 18 may or may not be provided with a tab which can fit into the slot 38 and engage the hollow interior of the top half of the mast 28. The mast 14 may or may not be completely hollow, depending upon the choice of mast material. The base 12 and the mast 14 are described as being collapsible in the preferred embodiment. Collapsible cardboard bases are available on the market which may be erected to form a four-footed stand or collapsed to lie in the flat. While this is desirable, it is not always necessary in all applications and therefore these elements also be made non-collapsible. Moreover, the top half 28 and the bottom half 26 of the mast 14 could be made to screw together or otherwise fit by a non-bayonnet type connection.

The display sign 18 is, of course, only meant for purposes of illustration and, as was previously discussed, the net 16 could be of any polygonal shape, even though a square has been found to be the most practical configuration.

While the invention has been particularly shown and described with reference to the preferred embodiment thereof, it will be understood by those skilled in the art that various changes in form and detail may be made therein without departing from the spirit and scope of the invention.

What is claimed is:

1. A display apparatus comprising:

a flexible net adapted to receive display materials therein, said net having a multi-sided shape and including a center and a plurality of corners;

a mast having a top and a bottom end, said mast passing approximately through the center of said net, said net being attached to said mast; and, a base means attached to the bottom end of said mast for providing free-standing support to said mast, said flexible net substantially surrounding at least part of said mast and said corners of said net being brought up and being attached to said mast to form a bag-like configuration.

2. The display apparatus of claim 1 wherein said net is attached to said mast in the vicinity of the top end thereof.

3. The display apparatus of claim 2 wherein said mast includes hook-like means thereon, wherein said net is attached to said mast by said hook-like means.

4. The display apparatus of claim 3 wherein said base means includes at least three triangular shaped legs.

5. The display apparatus of claim 4 wherein said mast is collapsible and includes at least one pull-apart connection therein.

6. The display apparatus of claim 5 wherein said display apparatus includes a sign at the top thereof; and, said top of said mast includes a means for receiving said sign.

7. The display apparatus of claim 6 wherein said net is made of plastic and includes gaps approximately 1 × 1½ inches in dimensions.

8. The apparatus of claim 7 wherein said net is square in shape.

9. The display apparatus of claim 1 wherein said mast includes a slot means in the top thereof for receiving the corners of said net, whereby the corners of said net are attached to said mast by hooking a plurality of net loops into said slot means.

10. The display apparatus of claim 9 wherein said display apparatus further includes a sign adapted to be received in said slot means.

* * * * *